United States Patent [19]

Gurney

[11] Patent Number: 4,827,828

[45] Date of Patent: May 9, 1989

[54] CLAMPING MECHANISMS

[75] Inventor: David W. Gurney, Stevenage, United Kingdom

[73] Assignee: British Aerospace Public Limited Company, London, United Kingdom

[21] Appl. No.: 132,710

[22] Filed: Dec. 11, 1987

Related U.S. Application Data

[63] Continuation of Ser. No. 925,038, Oct. 30, 1986, abandoned.

[30] Foreign Application Priority Data

Oct. 31, 1985 [GB] United Kingdom ..... 8526845

[51] Int. Cl.[4] ..... F41F 3/04

[52] U.S. Cl. ..... 89/1.816; 403/322; 403/330

[58] Field of Search ..... 33/233, 235; 89/1.8, 89/1.811, 1.814, 1.815, 1.816, 1.819; 248/220.2, 222.1, 224.3, 224.4, 225.31; 403/322, 325, 330, 353

[56] References Cited

U.S. PATENT DOCUMENTS

| | | | |
|---|---|---|---|
| 2,972,933 | 12/1957 | Guthrie et al. | 89/1.814 |
| 3,193,899 | 5/1963 | Johnson | 24/241 S |
| 3,494,249 | 2/1970 | Choate | 89/1.8 |
| 3,572,780 | 3/1971 | Levin | 403/322 |
| 3,890,879 | 6/1975 | Looger et al. | 89/1.816 |

FOREIGN PATENT DOCUMENTS

AO022430 of 0000 European Pat. Off. .

OTHER PUBLICATIONS

European Search Report EP No. 86 30 8528; British Aerospace Memorandum from D. W. Gurney dated Apr. 14, 1987, re: European Patent Application No.: 86308528.8.

*Primary Examiner*—Stephen C. Bentley

*Attorney, Agent, or Firm*—Cushman, Darby & Cushman

[57] ABSTRACT

Described herein is a clamping mechanism for attaching and aligning a tubular member, for example a missile launch tube (7), to a support member, for example an optical sight/firing unit (1). The mechanism allows the required electrical connections to power supplies to be made while providing the necessary alignment for the effective launch of the missile system and retaining a rapid reloading cycle for the system.

4 Claims, 6 Drawing Sheets

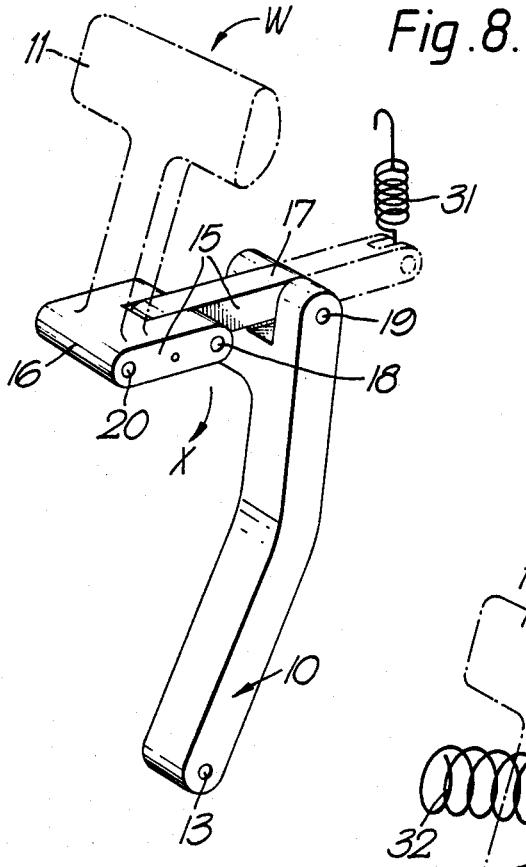
Fig. 8.
Fig. 9.
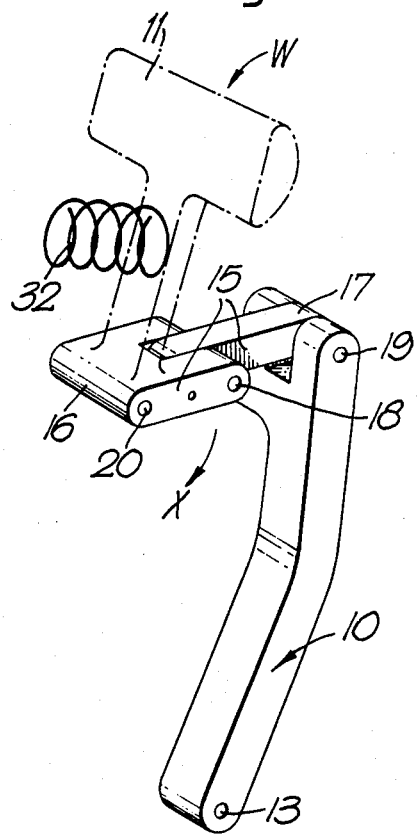

CLAMPING MECHANISMS

This is a continuation of application Ser. No. 925,038, filed Oct. 30, 1986, which was abandoned upon the filing hereof.

This invention relates to clamping mechanisms.

According to one aspect of the invention, there is provided a clamping mechanism for attaching a tubular member to a support member, the tubular member having a location portion adapted for engagement with a corresponding locating portion of the support member, the mechanism including clamping means for engaging said location portion and urging it into engagement with said corresponding locating portion when in a first position and for allowing relative movement between said support member and said tubular member when in a second position, and lever means for moving said clamping means from siad first to said second position, the lever means being operable to lock said clamping means in said first position.

The clamping means may comprise a lever member biased to said first position, one end of said lever member being pivotably attached to said support member.

The lever means may include linkage means with which it is connected to said clamping means.

Advantageously, said linkage means comprises a toggle arrangement of interconnecting lever elements which locks in said first position.

Preferably, said location portion is defined by a fixed bracket formed on said tubular member, said bracket having a slot formed in it for engaging said lever member.

Naturally, said corresponding locating portion is adapted to receive said bracket and may comprise a vee-shaped region formed in said support member.

According to a second aspect of the invention, there is provided a clamping mechanism for attaching a projectile launching tube to an optical sight/firing unit, the tube having a portion adapted for location with said unit, the mechanism including clamping means for engaging said portion and urging it into engagement with said unit when in a first position and for allowing relative movement beween said tube and said unit when in a second position to permit said location, and lever means for moving said clamping means from said first to said second position and for locking said clamping means in said first position.

Advantageously, said unit and said tube both include electrical connector means for providing electrical connections between the two when in said first position.

For a better understanding of the invention, reference will now be made, by way of example, to the accompanying drawings in which:

FIG. 8 illustrates a modified toggle arrangement incorporating a tension spring, and FIG. 9 shows a biasing arrangement incorporating a compression spring.

In some missile systems, each missile is individually stored in a container from which the missile is launched as required. As each container is a self-contained unit, it has to be connected to an installation which will provide the necessary power supply to achieve launch of the missile. An example of such an installation is an optical sight/firing unit which houses both the sighting arrangement and the necessary power supplies. For an effective missile launch, there must be accurate alignment between the sighting arrangement and the container boresight, as well as the required electrical connections to the power supplies. In a missile system having a rapid reload cycle, both these factors are important and therefore a rapid loading mechanism is required which provides the desired container/sighting arrangement alignment and the electrical connections between the container and the power supplies. Such a loading mechanism will be described with reference to a shoulder-launched missile system.

Figure 1:
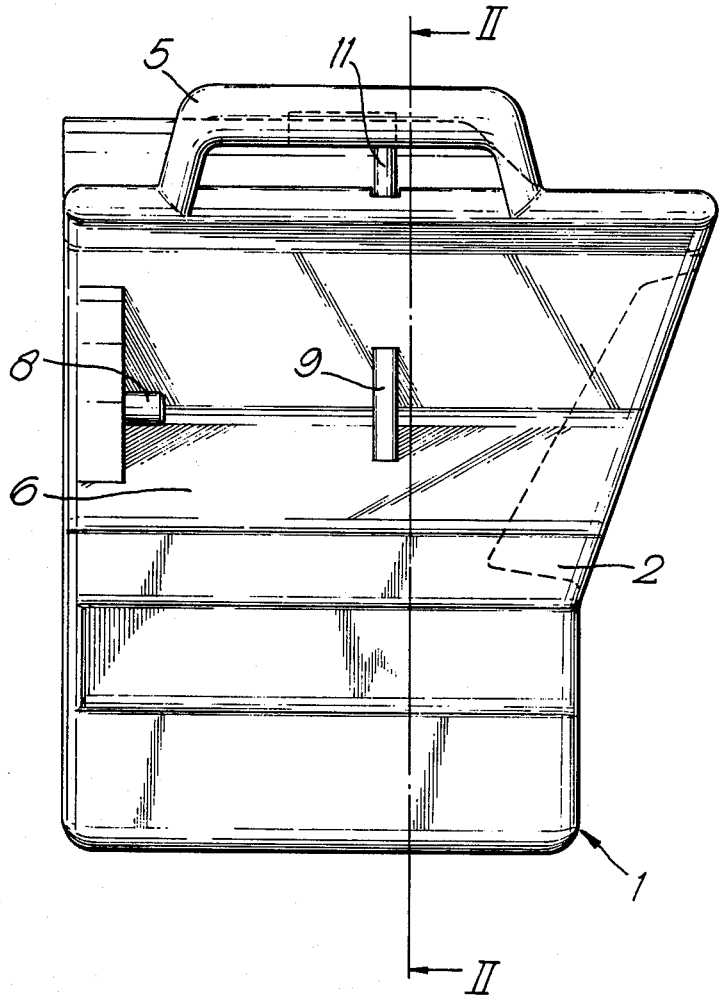
FIG. 1 is a schematic side elevation of an optical sight/firing unit.
Figure 2:
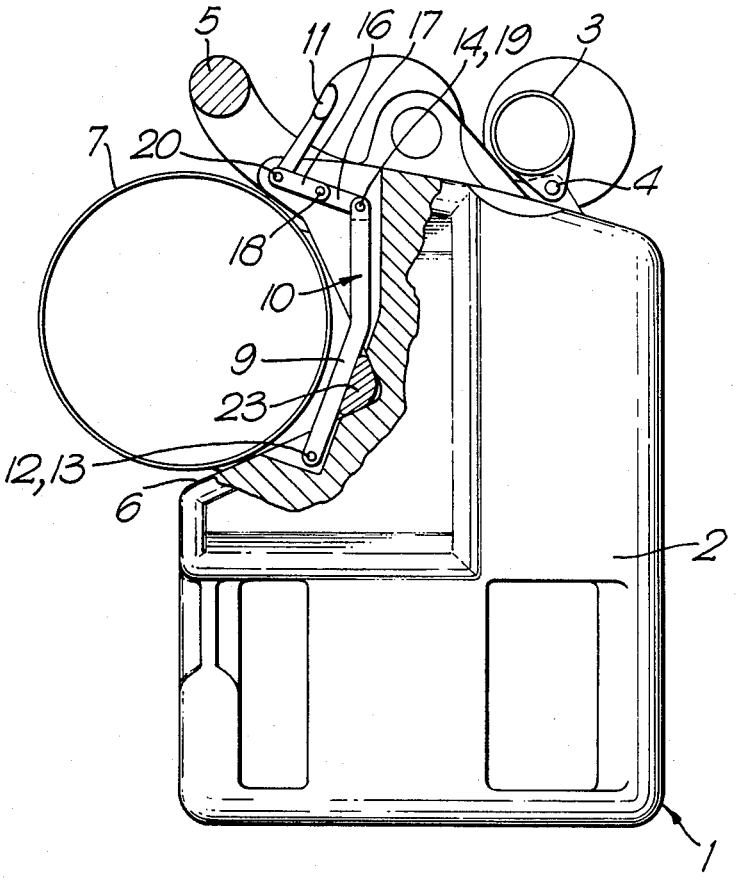
FIG. 2 is a part sectional view on II—II with a launching tube located in the FIG. 1 unit.

An optical sighting/firing unit 1 is shown in FIGS. 1 and 2. The unit 1 comprises a housing 2 in which various pieces of equipment and a battery (not shown) are mounted.

An optical sight 3 is mounted on top of the housing 2 and is adjustable to an operator's eye position by being pivotable about a pin 4. The unit 1 has a handle 5 by which it may be carried. A vee-shaped region 6 extends along the length of the housing 2 (FIG. 1) and receives a launching tube/container 7 as shown in FIG. 2. At the rearward end of the region 6, an electrical connector pin 8 is positioned, the pin 8 being supplied with energy from the battery (not shown) when required. Towards the center of the region 6, a portion 9 of a clamping bar 10 extends through the housing 2. The bar 10 is operated by a finger lever 11 which is positioned so as to extend through the housing 2 and lie adjacent the handle 5. One end 12 of the bar 10 is pivotably fixed to the housing 2 by a pin 13, the other end 14 being connected to the lever 11 via a toggle arrangement 15. The arrangement 15 comprises two lever members 16 and 17 which are pivotably pinned together by a pin 18, lever member 17 being pivotably connected to the end 14 of the bar 10 by a pin 19. Lever member 16 is rigidly fixed with respect to the finger lever 11 but is pivotably connected to the housing 2 by a pin 20. The bar 10 and the toggle arrangement 15 are normally biased towards a clamped position in which the lever members 16 and 17 are fully stretched (as shown in FIG. 2) by springs which are not shown in these figures but will be described later.

Figure 3:
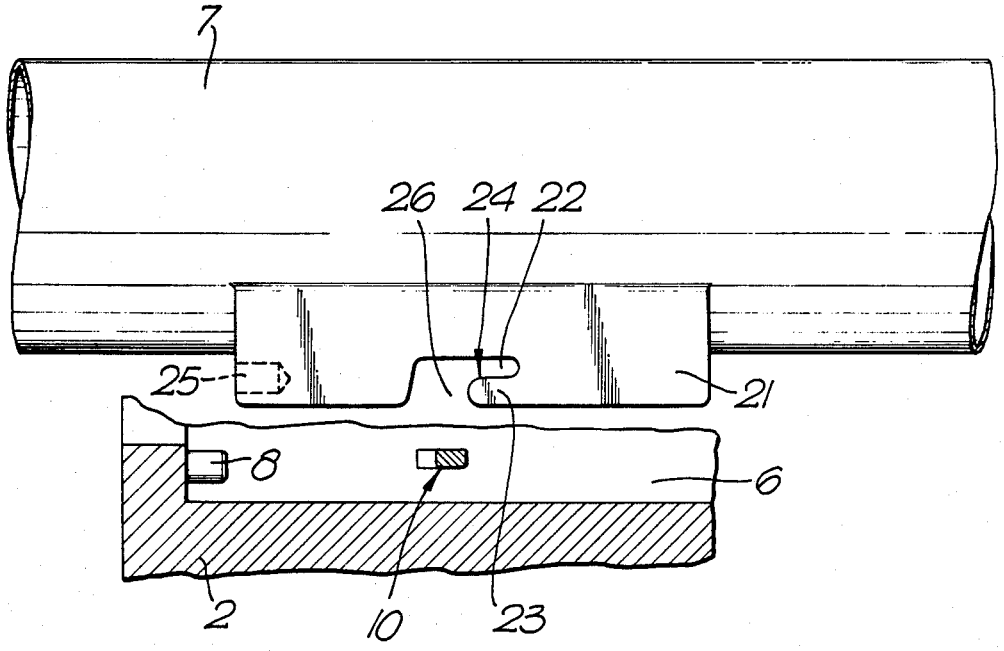
FIG. 3 shows the "mating" parts of the launching tube and the FIG. 1 unit.

Referring also to FIG. 3, the tube 7 has a bracket 21 formed on one side, the bracket being designed to engage with the vee-shaped region 6 of the unit 1 and to be held in position by the clamping force exerted by the springs (not shown) on the bar 10. The bracket 21 has a recessed slot 22 and a lug 23 formed in it. A detent 24, in the form of a small bump, is provided on the lug 23, the detent retaining the bar 10 in the slot 24 if the clamping force applied by the bar itself on the lug be lost at any time. At the rear end of the bracket 21, an electrical connector socket 25 is provided for engagement with the pin 8 on the unit 1, so that the unit 1 and the tube 7 can be electrically connected.

In use, the tube 7 is placed with one end on the ground with the bracket 21 within easy access. The unit 1 is then picked up by its handle 5 and pushed laterally along the side of the tube 7. During this time, the finger lever 11 is operated ie pulled towards the handle 5 so that the bar 10 is pulled away from its normal clamped position leaving a space for the location of the lug 23. The unit 1 is pushed along the tube 7 until the bracket 21 on the tube engages with the vee-shaped region 6 of the unit, and the bar 10 engages with the neck portion 26 of the recessed slot 21. Further pushing of the unit 1 onto the tube 7 makes the electrical connection between the two as the pin 8 of unit engages the socket 25 of the tube 7. The finger lever 11 is then released which allows the bar 10 to return to its clamped position, clamping the lug 23 to the vee-shaped region 6. The tube is then ready for launching the missile housed within it.

After the missile has been launched, the tube 7 and the unit 1 are separated by pulling the finger lever 11 towards the handle 5 and tilting the assembly so that the tube 7 slides out of engagement with the unit 1 and leaves it free ready for the next tube.

Figure 4:
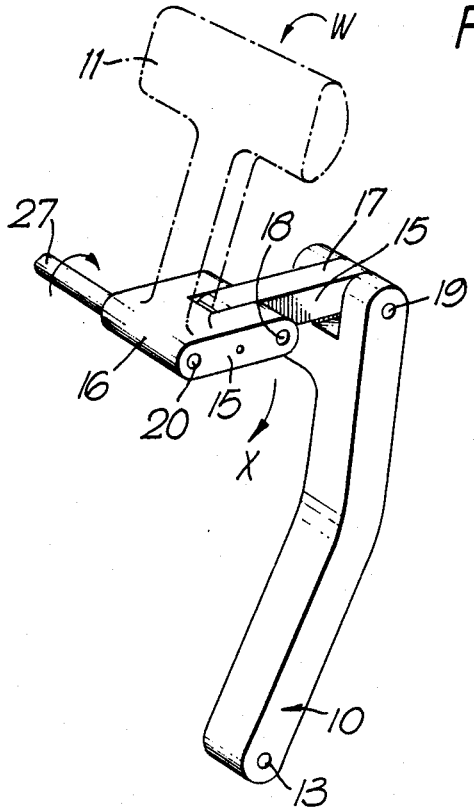
FIG. 4 shows an arrangement for biasing the clamping bar using a torsion bar.

As mentioned previously, the bar 10 is biased towards its clamping position by springs. FIGS. 4 to 9 illustrate various embodiments and positioning of the springs which may be used. In FIG. 4, a torsion bar 27 is attached to the lever member 16 at its pivot 20 so that when the lever 11 is pulled towards the handle 5 ie in the direction of arrow 'W', the toggle arrangement toggles in the direction 'X' opposing the force exerted by the bar 27.

Figure 5:
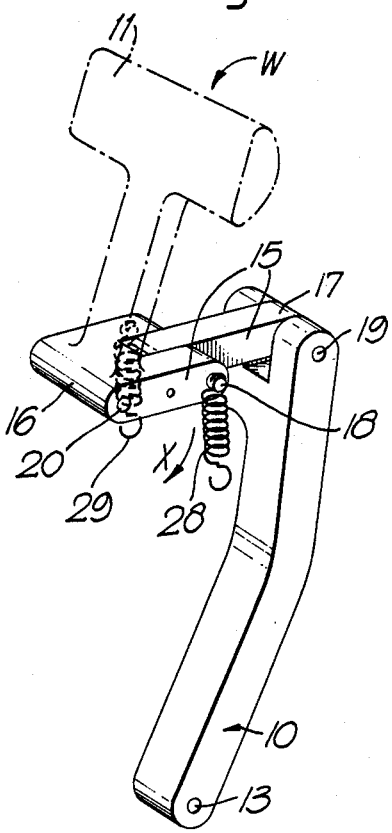
FIG. 5 shows a further biasing arrangement using a pair of tension springs.

In FIG. 5, a pair of springs 28,29 are attached one to each end of the pin 18 which pins the lever members 16 and 17 together. The other ends of the springs are attached to the housing 2. Movement of the lever 11 acts against the springs.

Figure 6:
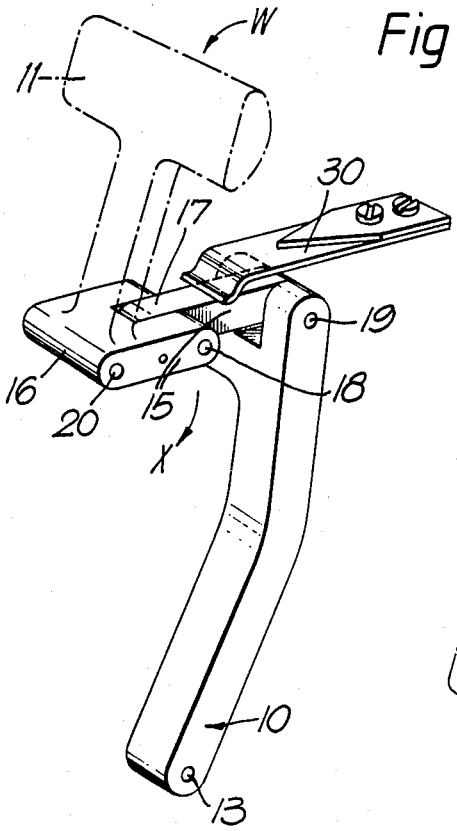
FIGS. 6 and 7 illustrate biasing arrangements incorporating cantilever springs.
Figure 7:
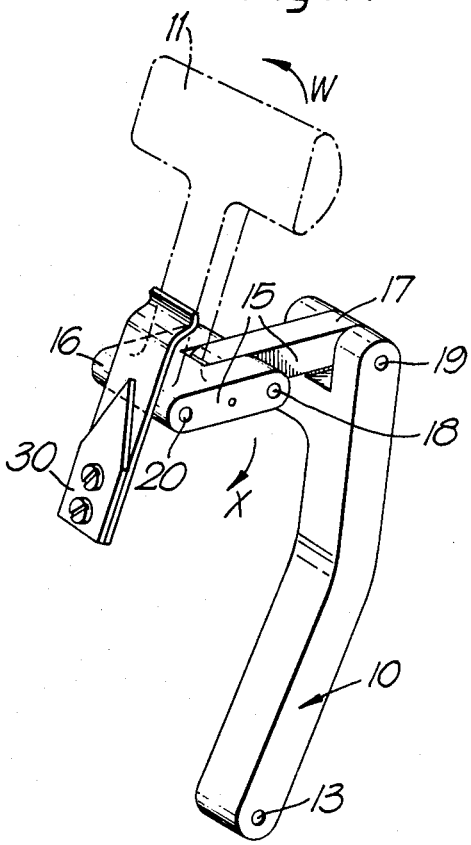

A cantilever spring 30 is shown in FIGS. 6 and 7 attached to the lever member 17 and to the finger lever 11 respectively, the other end of the spring 30 being attached to the housing 2. When the lever 11 is pulled in the direction 'W' in both figures, it acts against the spring directly as in FIG. 7 or indirectly as shown in FIG. 6.

In FIG. 8, the lever member 17 is extended beyond its pivot point with the clamping bar 10. A spring 31 is attached to the free end of the member 17 and its other end is attached to the housing 2.

In FIG. 9, a comparison spring 32 is attached directly to the lever 11 and when the lever is operated, it acts against the spring.

In a yet further arrangement (not shown) the clamping bar 10 may be spring-biased towards the unclamped position and the toggle arrangement 15 adapted when in its dead centre position—or in a position slightly beyond dead center—to lock the clamp bar 10 in its clamping position. In this arrangement the clamping bar 10 will initially be in an unclamped position and following location of the clamping bracket 21 in the vee-shaped region 6 and making of the electrical connection, the finger lever 11 is pulled towards the handle 5 to urge the toggle arrangements into a dead centre or slightly beyond dead centre position. When it is wished to release the tube, the finger lever is pulled away from the handle to release the clamping bar 10. In this arrangement a stop may be required to prevent movement of the toggle arrangement further than the locking position. For example, in FIG. 2, an abutment may be provided a short distance below the toggle pivot 18.

I claim:

1. Means for detachably connecting a projectile launching tube to an optical sight/firing unit comprising:

a bracket on the side of the tube having a lug extending longitudinally thereof;

means defining a recess in a side of the unit for receiving said lug therein but allowing relative movement therebetween longitudinally of the tube; and clamping means mounted to the unit including:

a bar having one end thereof mounted to the unit for pivotal movement about an axis generally parallel to the tube and movable between a first position engaging said lug and clamping it in said recess and a second position disengaging said lug to allow relative movement between the tube and the unit; and manually-operable lever means connected to the other end of said bar for moving it between said positions and for locking it in said first position.

2. The structure defined in claim 1 wherein the lever means includes a toggle arrangement which locks in the first position.

3. The structure defined in claim 2 including spring means biasing the toggle arrangement into the locking position.

4. The structure defined in claim 1 including disconnectable electrical connector means on the tube and the unit connectable on relative longitudinal movement therebetween to position the lug for engagement by the bar.

* * * * *